United States Patent [19]

Seaman

[11] 4,010,228

[45] Mar. 1, 1977

[54] CARBURETOR

[75] Inventor: Jack L. Seaman, Fairport, N.Y.

[73] Assignee: General Motors Corporation, Detroit, Mich.

[22] Filed: June 20, 1975

[21] Appl. No.: 588,886

[52] U.S. Cl. ..... 261/23 A; 74/522; 251/325; 123/325 T

[51] Int. Cl.[2] ..... F02M 9/04

[58] Field of Search ..... 261/23 A, 39 D; 251/325; 74/522, 525, 524; 123/325 T

[56] References Cited

UNITED STATES PATENTS

| | | | |
|---|---|---|---|
| 827,981 | 8/1906 | Klopfer | 251/325 |
| 1,153,973 | 9/1915 | Puscariu et al. | 251/325 |
| 1,501,605 | 7/1924 | Lane | 74/524 |
| 2,022,511 | 11/1935 | Lewis | 74/522 |
| 2,031,709 | 2/1936 | Hunt | 261/39 B |
| 2,036,020 | 3/1936 | Chandler | 261/23 A |
| 3,092,088 | 6/1963 | Goossak et al. | 261/23 A |
| 3,544,083 | 12/1970 | Currie | 261/23 A |
| 3,841,612 | 10/1974 | Pruchno et al. | 261/23 A |
| 3,842,810 | 10/1974 | Atsumi et al. | 261/23 A |
| 3,852,379 | 12/1974 | Atsumi | 261/23 A |

*Primary Examiner*—Tim R. Miles
*Attorney, Agent, or Firm*—C. K. Veenstra

[57] ABSTRACT

A carburetor, adapted to supply a lean air-fuel mixture to the main chamber and a rich air-fuel mixture to the auxiliary chamber of a stratified charge internal combustion engine, has an auxiliary induction passage formed as a cylindrical bore. The auxiliary induction passage receives air from the main induction passage through a lateral inlet port. A throttle in the auxiliary induction passage is formed as a hollow cylinder conforming to the cylindrical bore and is axially reciprocable past the port to control flow therethrough. Fuel is introduced into the transfer passage in accordance with air flow therethrough, and idle fuel is introduced directly into the cylindrical bore.

6 Claims, 7 Drawing Figures

CARBURETOR

This invention relates to a carburetor adapted for use on a stratified charge internal combustion engine and, more particularly, to a carburetor having an auxiliary induction passage containing an axially reciprocable cylindrical throttle adapted to control a portion of the air-fuel mixture delivered to such an engine.

Engines operating on very lean air-fuel mixtures have been known to possess certain advantages in terms of fuel consumption and exhaust emissions. Some such engines operate by igniting a small amount of a rich air-fuel mixture in an auxiliary chamber and using the burning mixture from the auxiliary chamber to ignite a larger amount of a very lean air-fuel mixture in a main chamber. This invention provides a carburetor adapted to provide the small amount of rich mixture to the auxiliary chamber and the larger amount of lean mixture to the main chamber.

In the carburetor provided by this invention, the auxiliary induction passage is formed as a cylindrical bore and contains a cylindrical throttle conforming to the bore. A transfer passage receives the air from the main induction passage and delivers it to the auxiliary passage bore through a lateral inlet port. The throttle is reciprocable past the port to control flow through the auxiliary induction passage. The carburetor provided by this invention thus may be distinguished from known stratified engine carburetors in which an auxiliary induction passage has been controlled by a conventional butterfly type throttle.

The advantages of this invention and the details of construction of two embodiments will be apparent from the remainder of the specification and the drawings in which.

Figure 1:
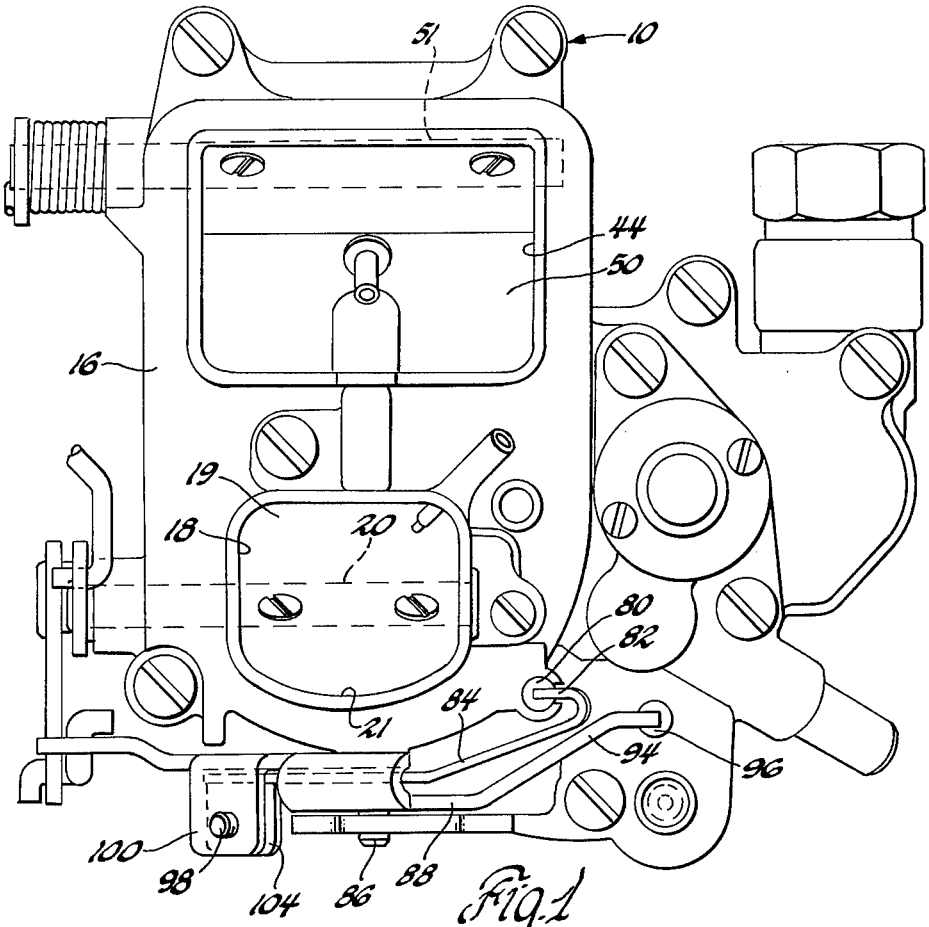
FIG. 1 is a top plan view of one embodiment of a carburetor constructed in accordance with this invention and illustrating the linkage for operating the auxiliary throttle.

Referring first to FIGS. 1 through 5, a carburetor 10 is formed by a fuel bowl section 12 disposed between a lower throttle body section 14 and an upper air horn section 16. A main induction passage 18 extends vertically through carburetor 10 and has a choke valve 19 disposed on a choke shaft 20 in the air inlet 21 formed in air horn section 16, a venturi cluster 22 formed in fuel bowl section 12, and a main throttle 24 disposed on a main throttle shaft 26 in throttle body 14.

Fuel bowl section 12 also defines a fuel bowl 28. A main metering jet 30 opens from fuel bowl 28 into a main fuel passage 32 which extends to a main discharge nozzle 33 in venturi cluster 22. A main metering rod 34 is suspended from a hanger 36 carried on a vacuum responsive piston 38 to control flow through jet 30. A main idle pick-up tube 40 receives fuel from main fuel passage 32 and discharges it through main idle ports 42 disposed adjacent main throttle 24.

It will thus be appreciated that the construction of and the manner of delivering fuel to main induction passage 18 is conventional in every respect and that main induction passage 18 may have additional well known systems and controls.

A secondary induction passage 44 also extends vertically through carburetor 10 and has a secondary throttle 46 secured on a secondary throttle body section 14. Secondary throttle 46 is controlled by linkage from main throttle 24 in a customary manner. Fuel flow to secondary induction passage 44 is controlled in a conventional manner by an air valve 50 disposed on an air valve shaft 51 in air horn section 16.

An auxiliary induction passage 52 is formed as a cylindrical bore extending vertically through fuel bowl section 12 and has an extension 54 leading through throttle body section 14. A transfer passage 56 inclines downwardly from main induction passage 18 and opens into the side of auxiliary induction passage 52 through a lateral inlet port 58. An auxiliary throttle 60 is formed as a hollow cylinder conforming to the bore of auxiliary induction passage 52. Auxiliary throttle 60 is reciprocable within the bore of auxiliary induction passage 52, and its upper edge 62 traverses inlet port 58 to control flow therethrough.

An auxiliary fuel passage 64 has an auxiliary pick-up tube 66 receiving fuel from fuel bowl 28 and an auxiliary discharge nozzle 68 extending into transfer passage 56 to deliver fuel to transfer passage 56 in accordance with air flow therethrough. An auxiliary idle discharge nozzle 70 opens from auxiliary fuel passage 64 directly into the upper portion of auxiliary induction passage 52, here formed as an annular recess 72 in air horn section 16. An air bleed 73 opens into auxiliary fuel passage 64 and acts as a siphon break.

A spring 74 seats on a ledge 76 formed in fuel bowl section 12 and biases auxiliary throttle 60 upwardly. Auxiliary throttle 60 has a diametral web 78 at its upper end which is engaged by plunger pin 80. Plunger pin 80 is operated by an arm 82 of a lever 84 pivotally mounted at 86 on air horn section 16. An intermediate lever 88 also is pivotally mounted at 86 and is connected by a link 90 to a main throttle lever 92 secured to main throttle shaft 26. Intermediate lever 88 also has an arm 94 extending to an accelerator pump stem 96.

An adjusting screw 98 is carried in a tang 100 on intermediate lever 88 and its head 102 restrains a tang 104 of auxiliary throttle lever 84, a spring 106 maintaining tang 104 in engagement with screw head 102.

Figure 2:
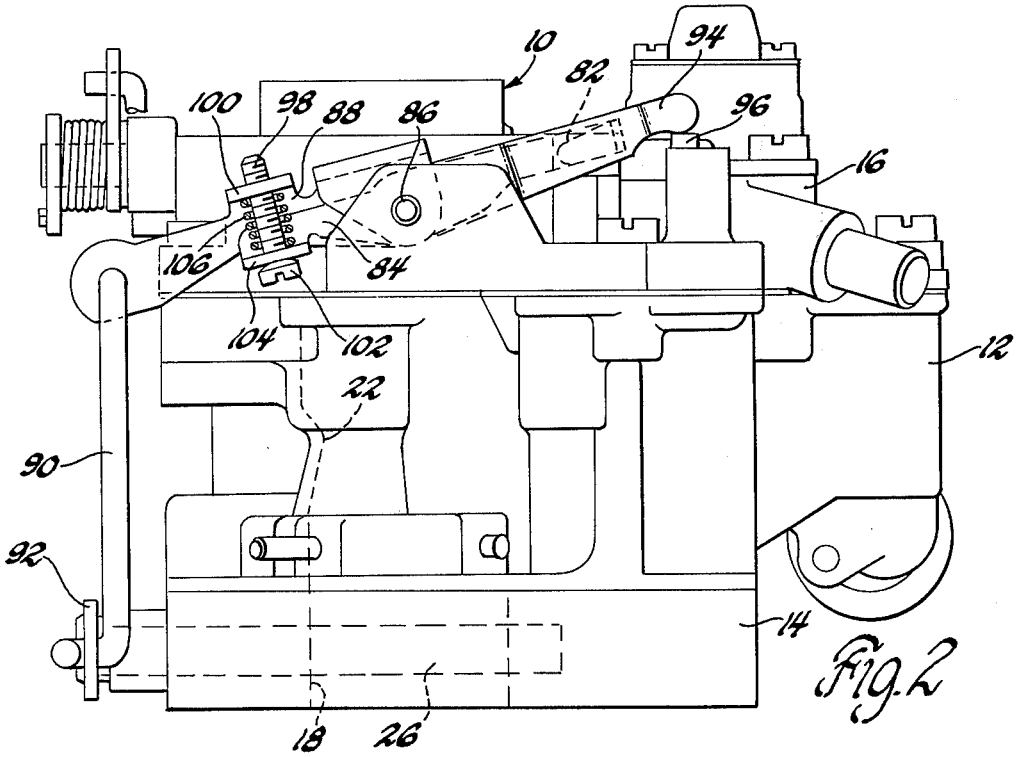
FIG. 2 is a front elevational view of the FIG. 1 carburetor further illustrating the linkage for operating the auxiliary throttle.
Figure 3:
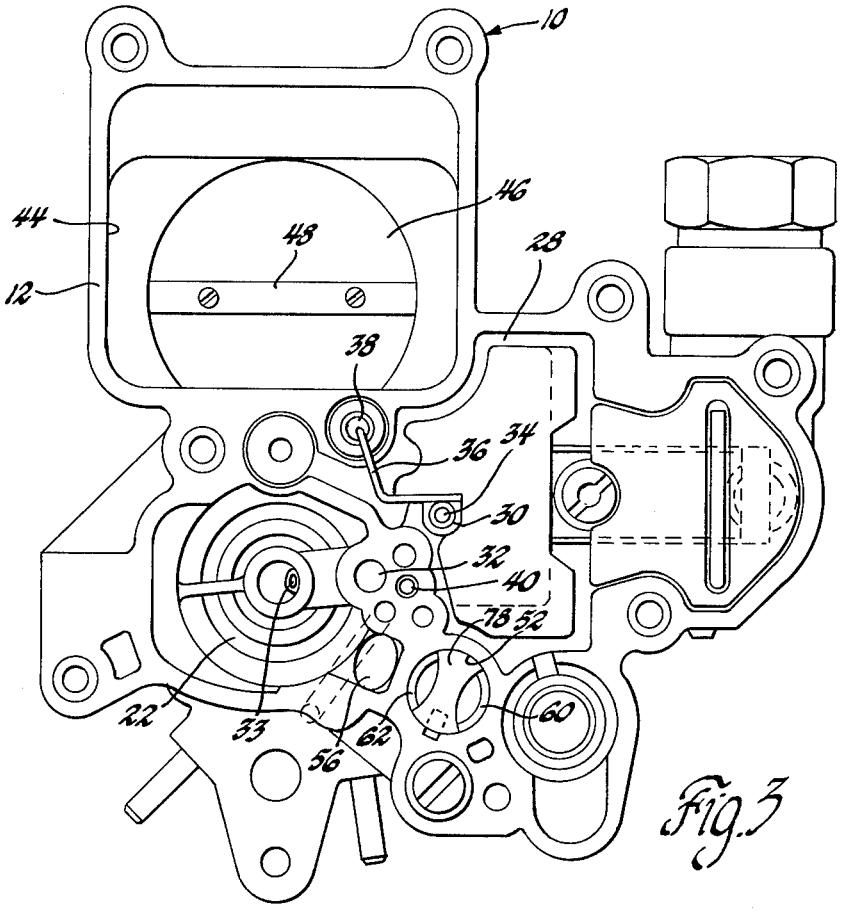
FIG. 3 is a top plan view of the FIG. 1 carburetor with the air horn removed to illustrate the location of the air and fuel passages.
Figure 4:
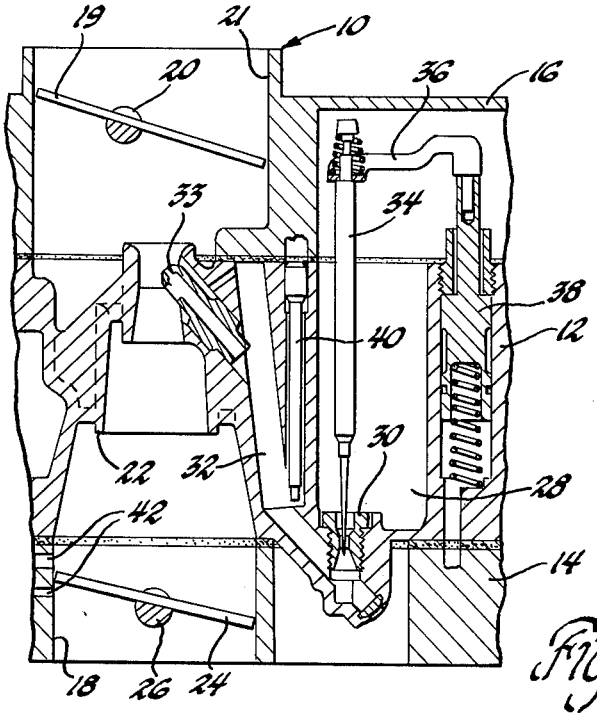
FIG. 4 is a schematic sectional view of the FIG. 1 carburetor illustrating its main induction passage and main fuel passage.
Figure 5:
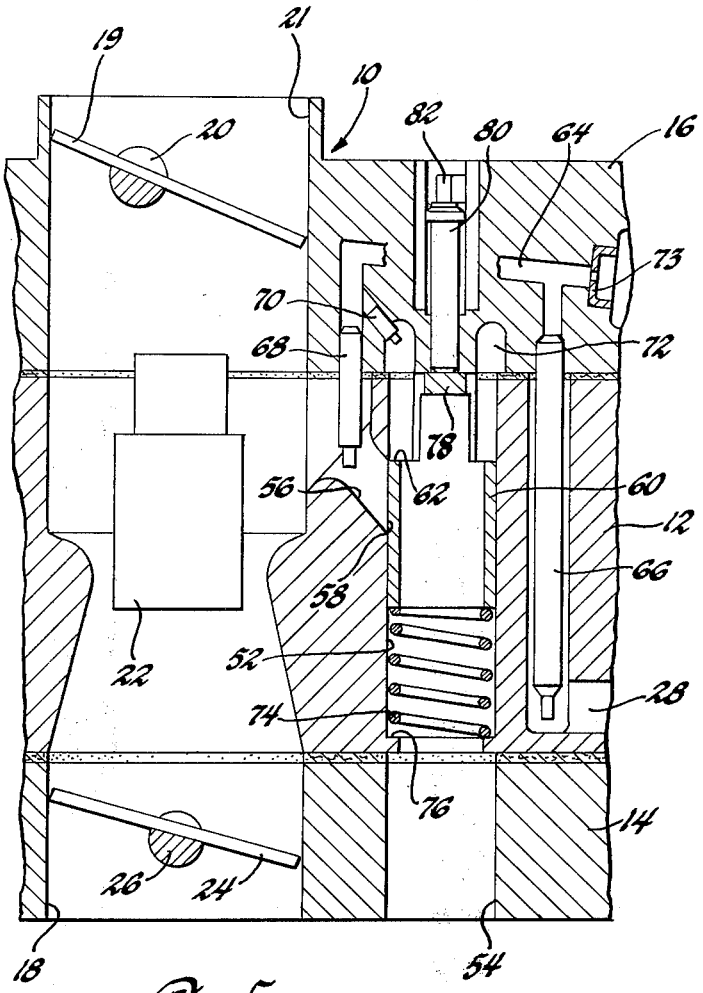
FIG. 5 is a schematic sectional view of the FIG. 1 carburetor illustrating its main and auxiliary induction passages and auxiliary fuel passage.

In operation, as main throttle 24 is opened to permit air flow through main induction passage 18 and venturi cluster 22, fuel is drawn from fuel bowl 28 past main metering rod 34 and through main jet 30 and main fuel passage 32 to supplement the idle fuel flow through main idle pick-up tube 40 and idle discharge ports 42. Simultaneously, main throttle lever 92 lifts link 90 to pivot intermediate lever 88 clockwise as shown in FIG. 2. Adjusting screw 98 then pivots auxiliary throttle lever 84 clockwise as shown in FIG. 2, and its arm 82 pushes plunger pin 80 and auxiliary throttle 60 downwardly against the bias of spring 74. The upper edge 62 of auxiliary throttle 60 thus exposes a greater portion of inlet port 58 to permit increased air flow from main induction passage 18 through transfer passage 56, auxiliary throttle 60, auxiliary induction passage 52 and extension 54. Fuel is drawn from fuel bowl 28 through auxiliary pick-up tube 66, auxiliary passage 64 and auxiliary discharge nozzle 68 into transfer passage 56 to supplement the idle fuel flow through auxiliary fuel passage 64 and idle discharge nozzle 70.

When used on a stratified charge engine having both main and auxiliary chambers, auxiliary induction passage 52 delivers a rich air-fuel mixture to the auxiliary chamber and main induction passage 18 delivers a greater flów of a lean air-fuel mixture to the main chamber. It will be appreciated, however, that carburetor 10 may be used in other applications.

Figure 6:
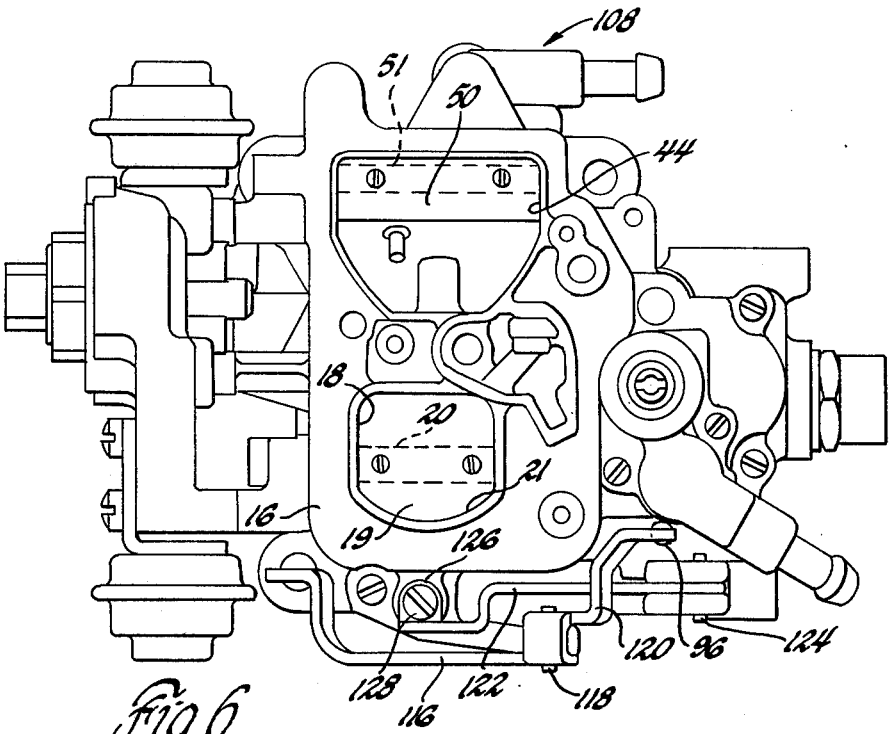
FIG. 6 is a top plan view of a second embodiment of a carburetor constructed in accordance with this invention and illustrating the linkage for operating the auxiliary throttle.
Figure 7:
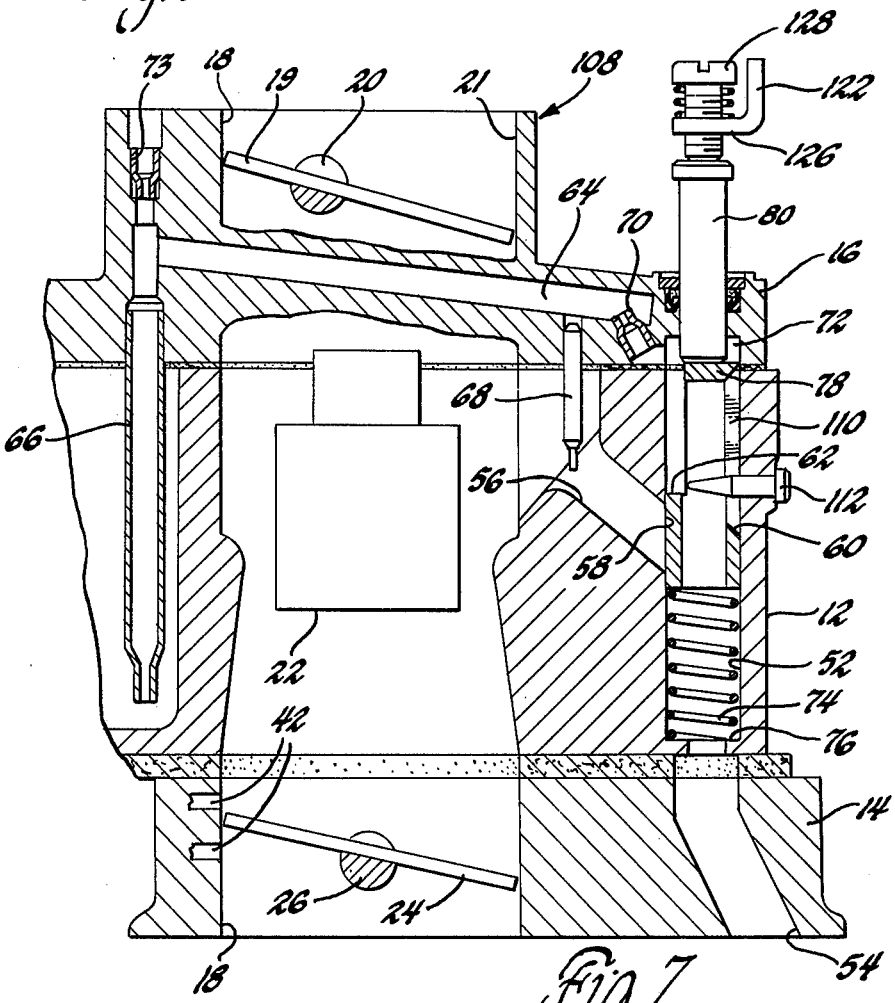
FIG. 7 is a schematic sectional view of the FIG. 6 carburetor illustrating its main and auxiliary induction passages and auxiliary fuel passage.

The carburetor shown in FIGS. 6 and 7 is similar in many respects to that shown in FIGS. 1 through 5, and identical reference numerals are used to identify similar parts.

Referring to FIGS. 6 and 7, a carburetor 108 has a main induction passage 18 extending vertically through air horn section 16, fuel bowl section 12 and throttle body section 14. A transfer passage 56 inclines downwardly from induction passage 18 and opens into the side of an auxiliary induction passage 52 again formed as a cylindrical bore extending vertically through fuel bowl section 12. An auxiliary throttle 60 is formed as a hollow cylinder conforming to the cylindrical bore of auxiliary induction passage 52.

Auxiliary throttle 60 is reciprocable, and its upper edge 62 is formed with an axially extending contour which traverses the inlet port 58 from transfer passage 56 to control flow therethrough. Auxiliary throttle 60 has a radially-opening axially-extending slot 110 which receives a pin 112 projecting from the side of auxiliary induction passage bore 52 to maintain the contoured upper edge 62 of auxiliary throttle 60 aligned with inlet port 58.

Auxiliary fuel passage 64 has an auxiliary pick-up tube 66 receiving fuel from fuel bowl 28 and an auxiliary discharge nozzle 68 extending into transfer passage 56 to deliver fuel to transfer passage 56 in accordance with air flow therethrough. An air bleed 73 opens into fuel passage 64 and acts as a siphon break. Auxiliary fuel passage 64 also has an auxiliary idle discharge nozzle 70 opening into the upper portion of auxiliary induction passage 52, again formed as a recess 72 in air horn section 16.

Auxiliary throttle 60 has a web 78 biased against a plunger pin 80 by a spring 74.

An intermediate lever 116 is pivoted at 118 on air horn section 16 and has an arm 120 extending to an accelerator pump stem 96. An auxiliary throttle lever 122 is pivoted at 124 on air horn section 16 and has a tang 126 carrying an adjusting screw 128 which engages plunger pin 80.

In operation, as main throttle 24 is opened to permit increased air flow through main induction passage 18, the left hand end of intermediate lever 116 as shown in FIG. 6 is lifted and arm 120 is lowered. Arm 120 engages auxiliary throttle lever 122 to lower tang 126 and push plunger pin 80 and auxiliary throttle 60 downwardly against spring 74. Additional air may then flow through transfer passage 56 past the upper edge 62 of auxiliary throttle 60 and through auxiliary throttle 60 and auxiliary induction passage 52.

It will be appreciated that, in each embodiment, the linkage connecting the auxiliary throttle with the main throttle permits closure of the main throttle even if the auxiliary throttle were to remain open. In addition the adjusting screws 98 and 128 permit the position of the auxiliary throttle to be adjusted relative to the main throttle for accurate idle flow rates.

The embodiments of the invention in which an exclusive property or privilege is claimed are defined as follows:

1. A carburetor comprising a fuel bowl, a main induction passage, a main fuel passage extending from said bowl to said main induction passage, a main throttle in said main induction passage for controlling flow therethrough, an auxiliary induction passage formed as a cylindrical bore, a transfer passage extending from said main induction passage to the side of said auxiliary induction passage and opening thereinto through an inlet port, an auxiliary fuel passage extending from said bowl to said transfer passage, an auxiliary throttle formed as a cylinder conforming to said cylindrical bore, said auxiliary throttle being axially reciprocable in said bore and having an edge traversing said port for controlling flow therethrough, and means operably connecting said auxiliary throttle and said main throttle whereby as said main throttle opens to permit increased flow through said main induction passage said auxiliary throttle is axially displaced in said bore to permit increased flow through said transfer passage, said inlet port and said auxiliary induction passage.

2. A carburetor comprising a fuel bowl, a main induction passage, a main fuel passage extending from said bowl to said main induction passage, a main throttle in said main induction passage for controlling flow therethrough, an auxiliary induction passage formed as a cylindrical bore, a transfer passage extending from said main induction passage to the side of said auxiliary induction passage and opening thereinto through an inlet port, an auxiliary fuel passage extending from said bowl to said transfer passage, an auxiliary throttle formed as a hollow cylinder conforming to said cylindrical bore, said auxiliary throttle being axially reciprocable in said bore and having an upstream edge traversing said port for controlling flow therethrough, and means operably connecting said auxiliary throttle and said main throttle whereby as said main throttle opens to permit increased flow through said main induction passage said auxiliary throttle is axially displaced in said bore to permit increased flow through said transfer passage, said inlet port, said auxiliary throttle and said auxiliary induction passage.

3. A carburetor comprising a fuel bowl, a main induction passage, a main fuel passage extending from said bowl to said main induction passage, a main throttle in said main induction passage for controlling flow therethrough, an auxiliary induction passage formed as a cylindrical bore, a transfer passage extending from said main induction passage to the side of said auxiliary induction passage and opening thereinto through an inlet port, an auxiliary fuel passage extending from said bowl to said transfer passage, an auxiliary throttle formed as a hollow cylinder conforming to said cylindrical bore, said auxiliary throttle being axially reciprocable in said bore and having an edge traversing said port for controlling flow therethrough, an idle fuel passage extending from said auxiliary fuel passage to said auxiliary induction passage for discharging fuel through said auxiliary throttle, and means operably connecting said auxiliary throttle and said main throttle whereby as said main throttle opens to permit increased flow through said main induction passage said auxiliary throttle is axially displaced in said bore to permit increased flow through said transfer passage, said inlet port and said auxiliary induction passage.

4. A carburetor comprising a fuel bowl, a main induction passage, a main fuel passage extending from said bowl to said main induction passage, a main throttle in said main induction passage for controlling flow therethrough, an auxiliary induction passage formed as a cylindrical bore, a transfer passage extending from said main induction passage to the side of said auxiliary induction passage and opening thereinto through an inlet port, an auxiliary fuel passage extending from said bowl to said transfer passage, an auxiliary throttle formed as a cylinder conforming to said cylindrical bore, said auxiliary throttle being axially reciprocable in said bore and having an edge formed with an axially extending contour traversing said port for controlling flow therethrough, one of said auxiliary throttle and said cylindrical bore having a radially-opening axially-extending slot and the other of said auxiliary throttle and said cylindrical bore having a projection extending into said slot to maintain said contour aligned with said port, and means operably connecting said auxiliary throttle and said main throttle whereby as said main throttle opens to permit increased flow through said main induction passage said auxiliary throttle is axially displaced in said bore to permit increased flow through said transfer passage, said inlet port and said auxiliary induction passage.

5. A carburetor comprising a main induction passage, a main throttle in said main induction passage for controlling flow therethrough, an auxiliary induction passage formed as a cylindrical bore, a transfer passage extending from said main induction passage to the side of said auxiliary induction passage and opening thereinto through an inlet port, an auxiliary throttle formed as a cylinder conforming to said cylindrical bore, said auxiliary throttle being axially reciprocable in said bore and having an edge traversing said port for controlling flow therethrough, a spring biasing said auxiliary throttle to obstruct said port, a plunger pin engaging said auxiliary throttle, a main throttle lever connected to said main throttle, and intermediate lever pivoted on said carburetor, a link connecting said levers for concommitant operation, and an auxiliary throttle lever pivoted on said carburetor, said auxiliary throttle lever including means engaging said plunger pin and means engaging said intermediate lever for pivoting said auxiliary throttle lever as said main throttle opens to permit increased flow through said main induction passage and thus causing said auxiliary throttle lever to axially displace said auxiliary throttle in said bore against the bias of said spring to permit increased flow through said transfer passage, said inlet port and said auxiliary induction passage, one of said means including an adjusting screw for varying the position of said auxiliary throttle relative to said intermediate lever and thus relative to said main throttle.

6. An internal combustion engine carburetor comprising a fuel bowl, a main induction passage having an air inlet for air flow to the engine, a main fuel passage extending frm said bowl to said main induction passage to deliver fuel thereto in accordance with air flow therethrough, a main throttle in said main induction passage for controlling flow therethrough, an auxiliary induction passage formed as a cylindrical bore, a transfer passage extending from said main induction passage to the side of said auxiliary induction passage and opening thereinto through an inlet port for transferring a portion of the air flowing through said main induction passage to said auxiliary induction passage, an auxiliary fuel passage extending from said bowl to said transfer passage to deliver fuel thereto in accordance with air flow therethrough, an auxiliary throttle formed as a hollow cylinder conforming to said cylindrical bore, said auxiliary throttle being axially reciprocable in said bore and having an upstream edge formed with an axially extending contour traversing said port for controlling flow therethrough, said auxiliary throttle and said cylindrical bore including means preventing rotation of said auxiliary throttle in said bore to maintain said contour aligned with said port, an idle fuel passage extending from said auxiliary fuel passage to said auxiliary induction passage for discharging fuel through said auxiliary throttle and said auxiliary induction passage, a spring biasing said auxiliary throttle to obstruct said port, said auxiliary throttle having a diametral web, a plunger pin engaging said web, a main throttle lever connected to said main throttle, an intermediate lever pivoted on said carburetor, a link connecting said levers for concommitant operation, and an auxiliary throttle lever pivoted on said carburetor, said auxiliary throttle lever including means engaging said plunger pin and means engaging said intermediate lever for pivoting said auxiliary throttle lever as said main throttle opens to permit increased flow through said main induction passage and thus causing said auxiliary throttle lever to axially displace said auxiliary throttle in said bore against the bias of said spring to permit increased flow through said transfer passage, said inlet port, said auxiliary throttle and said auxiliary induction passage, one of said means including an adjusting screw for varying the position of said auxiliary throttle relative to said intermediate lever and thus relative to said main throttle.

* * * * *